US006548952B2

(12) United States Patent
Harberts et al.

(10) Patent No.: US 6,548,952 B2
(45) Date of Patent: Apr. 15, 2003

(54) CRT HAVING A DEFLECTION UNIT WITH ANTI-RINGING CHARACTERISTICS

(75) Inventors: Dirk Willem Harberts, Eindhoven (NL); Hendrik Dirk Van Den Berg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 5 days.

(21) Appl. No.: 09/966,437

(22) Filed: Sep. 28, 2001

(65) Prior Publication Data

US 2002/0038996 A1 Apr. 4, 2002

(30) Foreign Application Priority Data

Oct. 2, 2000 (EP) ..... 00203399

(51) Int. Cl.[7] ..... H01J 29/70
(52) U.S. Cl. ..... 313/440; 313/439; 313/432
(58) Field of Search ..... 313/412, 413, 313/421, 425, 426, 428, 430, 432, 439, 440; 335/213

(56) References Cited

FOREIGN PATENT DOCUMENTS

WO WO9966526 12/1999 ..... H01J/29/70

*Primary Examiner*—Vip Patel

(57) ABSTRACT

A cathode ray tube (1) having an improved deflection unit (11) is described. The deflection unit (11) comprises line and/or frame coils that comprise a composition of wires having a conductive coating and wires having a non-conductive coating. Such deflection units have a good anti-ringing performance, while the good adhesion characteristics of non-conducting coated wires are maintained.

5 Claims, 2 Drawing Sheets

CRT HAVING A DEFLECTION UNIT WITH ANTI-RINGING CHARACTERISTICS

The invention relates to a cathode ray tube comprising an electron gun for generating at least one electron beam, and a deflection unit for deflecting the at least one electron beam across a display screen, the deflection unit comprising a line deflection coil system and a frame deflection coil system, the line deflection coil system and/or the frame deflection coil system having coils which are at least partly provided with a conductive layer. The invention also relates to a deflection coil system.

WO 99/66526 (Attorney's docket PHN 16960) describes a cathode ray tube (CRT) having line and frame deflection coil systems which are at least partly provided with a conductive layer. Such a layer reduces the occurrence of unwanted high-frequency electromagnetic oscillations between the line and the frame coil systems, which oscillations are known as the "ringing" phenomenon. This phenomenon becomes visible in a gradually decaying curtain of lighter and darker vertical bars at the left-hand side of the screen.

The document discloses various ways of applying the conductive layer to the coil systems. In a first way, a conductive material layer is provided in one of the outer layers, e.g. the bonding layer of the wire used for winding the coils. During formation of the coils, the adhesive layers melt together and a conductive layer is formed in and on the coils. An alternative method of application is impregnating the coils with a solution of a conductive material and, subsequently, allowing the solution to dry. Thereafter, coil parts that should remain uncovered have to be cleaned. The use of PEDOT, ITO or ATO solutions is preferred.

The described ways of providing the coils with a conductive layer have their drawbacks. The first method has the drawback that wires having a conductive layer are more expensive. Furthermore, the adhesive and the winding characteristics of said wire are inferior to those of conventional wires. The second method requires additional process steps in the manufacture of the coils for a CRT. These additional process steps increase the cost price of the CRT.

It is an object of the invention to provide a cathode ray tube in which the indicated drawbacks are substantially reduced in a very simple and practical manner, without substantially impairing the required damping characteristics. To this end, the invention is characterized in that the coils comprise a composition of first electrically conductive wires having an electrically non-conductive layer surrounding the first electrically conductive wires and second electrically conductive wires having an electrically conductive layer surrounding the second electrically conductive wires. Coils provided with a conductive coating in this way have the surprising advantage that the indicated problems are reduced, while the required damping characteristics with respect to the unwanted high-frequency oscillations remain substantially the same as in the prior-art solutions where all wires have an electrically conductive layer.

Advantageous embodiments of the invention are described in the dependent claims.

These and other aspects of the invention will be elucidated with reference to the embodiments described hereinafter.

In the drawings.

In general, like reference numerals identify like elements.

Figure 1:
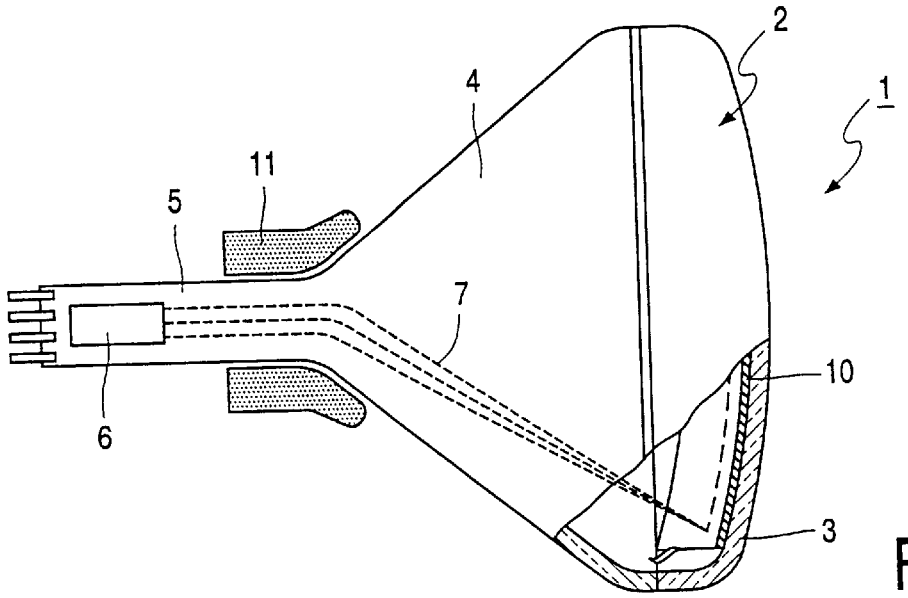
FIG. 1 is a sectional view of a cathode ray tube according to the invention.
Figure 2:
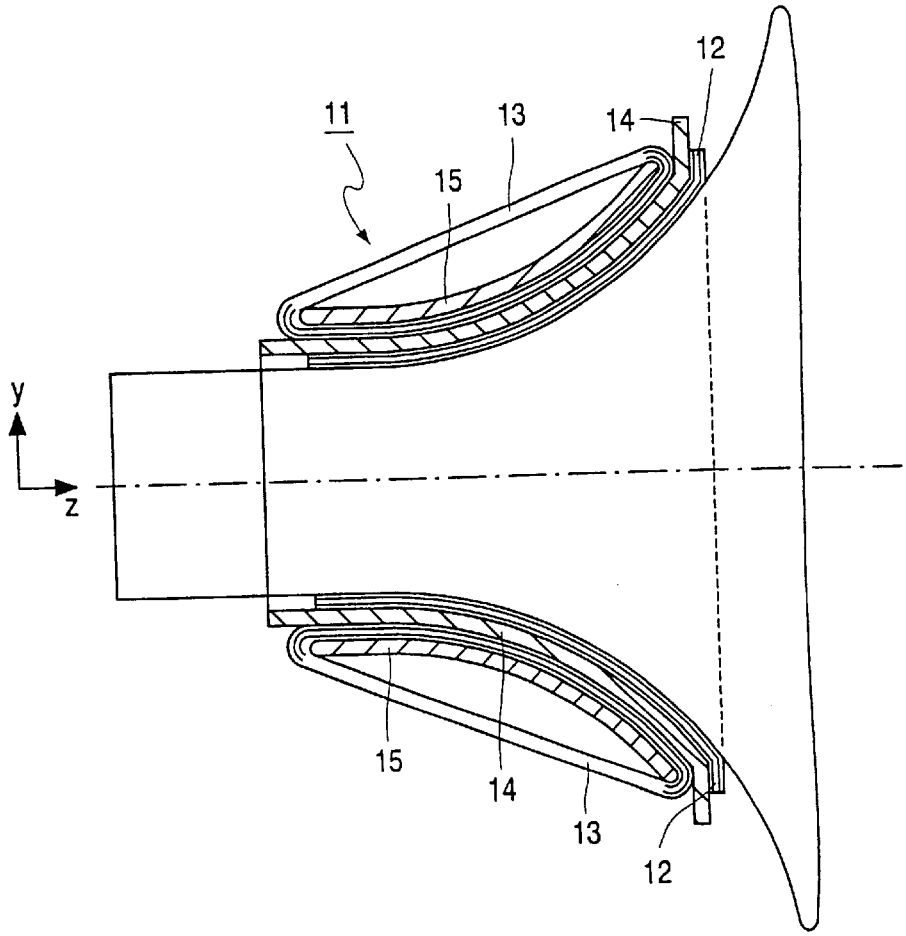
FIG. 2 is a sectional view of a deflection coil according to the invention.

A cathode ray tube 1 as shown in FIG. 1 has an evacuated envelope 2 which comprises a display window 3, a cone portion 4 and a neck 5. The neck 5 accomodates an electron gun 6 for generating at least one electron beam 7. A display screen 10 is situated on the inner side of the display window. The display screen comprises a large number of phosphor elements that emit light after being hit by the at least one electron beam 7. On their way to the display screen 10, the at least one electron beam 7 is deflected in two mutually perpendicular directions across the display screen by means of deflection unit 11. These directions are commonly referred to as the line direction, in which the display is scanned at a relatively high frequency, and the frame direction, in which the display screen is scanned at a relatively low frequency. To this end, the deflection unit 11 comprises a line deflection coil system 12 and a frame deflection coil system 13 as is shown in FIG. 2, wherein a sectional view along the y-direction of an example of a deflection unit is shown.

During deflection of the electron beam(s), a phenomenon hereinafter referred to as "ringing" occurs. A sudden change of the magnetic deflection field generated by the line deflection coil system 12 causes an excitation of the line deflection coil system 12 and/or the frame deflection coil system 13. This phenomenon particularly occurs during flyback of the line deflection and causes a deviation in the frame deflection direction on a line written in the line deflection direction. This deviation is particularly visible in an area at the edge of the display screen, i.e. the location where line scanning of the display screen starts.

The deflection unit comprises a line deflection coil system for deflecting the electron beam in the line deflection direction (the x-direction) and a frame deflection coil system for deflecting the electron beam in the frame deflection direction (the y-direction). In this example, the line deflection coil system 12 includes two saddle-shaped coils and the frame deflection coil system 13 includes a toroidal coil. A support 14 is situated between the systems 12 and 13. Said toroidal coil is wound on a core 15. This example is not to be construed as limiting the scope of the invention. The deflection coil systems may be of the saddle-shaped type, the toroidal type or of any other type.

The coils comprise electrically conductive wires. WO 99/66526 discloses that, to suppress the ringing phenomenon, a conductive material may be provided in one of the outer layers, e.g. in the adhesive layer of the wire used for winding the coils. During formation of the deflection coils, the adhesive layers melt together and a conductive layer is formed in and on the deflection coils. This way of reducing the ringing phenomenon has the drawback that this type of wire is relatively expensive and negatively influences the winding and adhesion during coil formation.

It has been shown by experiment that the indicated drawbacks may be substantially reduced in a very simple and practical manner, without substantially impairing the required damping characteristics. To this end, the invention is characterized in that the coils comprise a composition of first electrically conductive wires having an electrically non-conductive layer surrounding the first electrically conductive wires (i.e. conventional wires) and second electrically conductive wires having an electrically conductive layer surrounding the second electrically conductive wires. Coils provided with a conductive coating in this way have the surprising advantage that the indicated problems are reduced, while the required damping characteristics with respect to the unwanted high-frequency oscillations remain substantially the same as in the prior art solutions where all wires have an electrically conductive layer.

Figure 3:
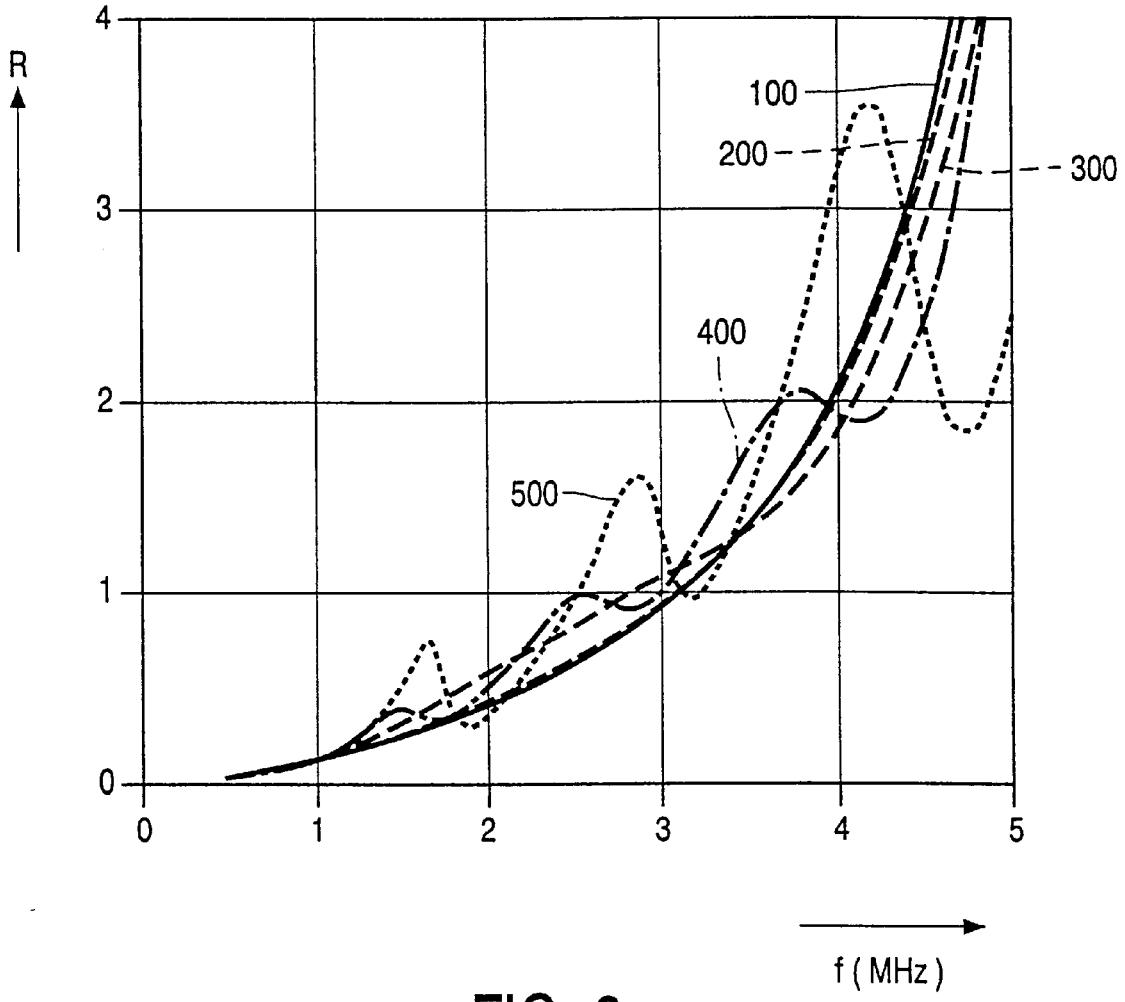
FIG. 3 shows a graph of a magnetical frequency response of a frame coil according to the invention.

FIG. 3 shows results of measurements in which the number M of wires with a conductive layer has been systematically varied with respect to the number N of conventional wires, in this case between zero and 4, per group of N+M wires. The figure shows the common-mode response R of a frame coil system measured as a function of the frequency f. This type of measurement is described by D. Harberts in the proceedings of the International Symposium of the Society for Information Displays, vol. XXX, pages 898–901, held in May 1999.

Curve 100 is the response for a coil comprising 0 conventional wires and 4 wires with a conductive layer, per group of N+M wires.

Curve 200 is the response for a coil comprising 1 conventional wire and 3 wires with a conductive layer, per group of N+M wires.

Curve 300 is the response for a coil comprising 2 conventional wires and 2 wires with a conductive layer, per group of N+M wires.

Curve 400 is the response for a coil comprising 3 conventional wires and 1 wire with a conductive layer, per group of N+M wires.

Curve 500 is the response for a coil comprising 4 conventional wires and 0 wires with a conductive layer, per group of N+M wires.

It can be seen that, surprisingly, still good damping characteristics of the coil can be obtained with $N \leqq M$.

A coil having such a composition can be distinguished from a coil according to the prior art, since the wires having the conductive layer are normally black, which is caused by the applied graphite particles and the coil then comprises black wires.

A good electrical behavior of the coil is obtained if the N wires and the M wires are electrically connected parallel to each other. Since it is the conductive property of the layer around the wires that is important for suppressing of the ringing phenomenon, these types of wire do not need to be electrically connected to each other.

In summary, the invention relates to a cathode ray tube 1 having an improved deflection unit 11. The deflection unit comprises line and/or frame coils that comprise a composition of wires having a conductive coating and wires having a non-conductive coating. Such deflection units have a good anti-ringing performance, while the good adhesion characteristics of non-conducting coated wires are maintained.

It should be noted that the above-mentioned embodiments illustrate rather than limit the invention, and that those skilled in the art will be able to design many alternative embodiments without departing from the scope of the appended claims. In the claims, any reference sign placed between parentheses shall not be construed as limiting the claim. Use of the verb "to comprise" and its configurations does not exclude the presence of elements or steps other than those stated in a claim.

What is claimed is:

1. A cathode ray tube (1) comprising an electron gun (6) for generating at least one electron beam (7), and a deflection unit (11) for deflecting the at least one electron beam (7) across a display screen (10), the deflection unit (11) comprising a line deflection coil system (12) and a frame deflection coil system (13), the line deflection coil system (12) and/or the frame deflection coil system (13) having coils which are at least partly provided with a conductive layer, characterized in that the coils comprise a composition of first electrically conductive wires having an electrically non-conductive layer surrounding the first electrically conductive wires and second electrically conductive wires having an electrically conductive layer surrounding the second electrically conductive wires.

2. A cathode ray tube as claimed in claim 1, wherein only the frame deflection coil system (13) is provided with the composition of the first electrically conductive wires and the second electrically conductive wires.

3. A cathode ray tube as claimed in claim 1, wherein the composition comprises N wires of the first electrically conductive wires and M wires of the second electrically conductive wires, and $N \leqq M$.

4. A cathode ray tube as claimed in claim 3, wherein the N wires and the M wires are electrically connected parallel to each other.

5. A deflection coil system (12,13) having coils, which are at least partly provided with a conductive layer, wherein the coils comprise a composition of first electrically conductive wires having an electrically non-conductive layer surrounding the first electrically conductive wires and second electrically conductive wires having an electrically conductive layer surrounding the second electrically conductive wires.

* * * * *